US006374463B1

(12) United States Patent
Kaufman

(10) Patent No.: US 6,374,463 B1
(45) Date of Patent: Apr. 23, 2002

(54) CORNER CLIP

(76) Inventor: Kenneth J. Kaufman, 145 Main St., Apt. 403, Ludlow, VT (US) 05149

( * ) Notice: Subject to any disclaimer, the term of this patent is extended or adjusted under 35 U.S.C. 154(b) by 0 days.

(21) Appl. No.: 09/689,321

(22) Filed: Oct. 12, 2000

Related U.S. Application Data

(60) Provisional application No. 60/237,877, filed on Oct. 4, 2000.

(51) Int. Cl.[7] ..... B42F 1/02

(52) U.S. Cl. ..... 24/67.5; 24/67.3; 24/563; 24/565; 24/DIG. 8

(58) Field of Search ..... 24/67.3, 67.5, 24/67 CF, 67.9, 557, 558, 563, 565, DIG. 8; D8/395; D19/86; B42F 1/02, 1/12

(56) References Cited

U.S. PATENT DOCUMENTS

| | | | | | |
|---|---|---|---|---|---|
| 176,762 | A | | 5/1876 | Vanhorn | |
| 427,558 | A | * | 5/1890 | Dennis | 24/67 CF |
| 1,368,868 | A | | 2/1921 | Wertman | |
| 2,041,514 | A | | 5/1936 | Reiter | 24/259 |
| 2,435,174 | A | * | 1/1948 | Bell | 24/261 |
| 2,614,305 | A | | 10/1952 | Yeardley | 24/81 |
| 2,795,834 | A | | 6/1957 | Szoke | 24/257 |
| 2,908,954 | A | * | 10/1959 | Chaun | 24/66 |
| 3,286,381 | A | | 11/1966 | Wooge | 40/23 |
| 3,827,109 | A | * | 8/1974 | Langwell | 24/67.5 |
| 4,226,006 | A | | 10/1980 | Toyama | 23/3 L |
| 4,332,060 | A | | 6/1982 | Sato | 24/67.9 |
| 4,532,680 | A | | 8/1985 | Hashimoto | 24/67 R |
| 4,696,081 | A | | 9/1987 | Yen | 24/558 |
| 4,735,438 | A | | 4/1988 | Demarest, Jr. | 281/42 |
| 4,761,862 | A | | 8/1988 | Hiromori | 24/67.9 |
| 4,910,907 | A | | 3/1990 | Schlaegel | 43/44.6 |
| 5,022,124 | A | * | 6/1991 | Yiin | 24/67.9 |
| 5,079,808 | A | | 1/1992 | Brown | 24/67.7 |
| 5,404,622 | A | | 4/1995 | Sato | 24/67 CF |
| 5,533,236 | A | | 7/1996 | Tseng | 24/67.5 |
| 5,950,283 | A | | 9/1999 | Sato | 24/67 R |
| 6,015,166 | A | | 1/2000 | May | 281/42 |
| 6,018,849 | A | | 2/2000 | Royer | 24/67 CF |
| 6,018,850 | A | | 2/2000 | Lorber | 24/67.9 |
| 6,088,889 | A | | 7/2000 | Luther et al. | 24/489 |

FOREIGN PATENT DOCUMENTS

| | | | | |
|---|---|---|---|---|
| JP | 6-79580 | | 11/1994 | |
| JP | 7-31374 | | 6/1995 | |
| JP | 10-236048 | * | 9/1998 | B42F/1/02 |
| JP | 2000-1079 A | * | 1/2000 | B42F/1/02 |

* cited by examiner

*Primary Examiner*—Anthony Knight
*Assistant Examiner*—André L. Jackson
(74) *Attorney, Agent, or Firm*—Thomas, Kayden, Horstemeyer & Risley, LLP

(57) ABSTRACT

A preferred clip includes a body formed from a length of band-like material. The body incorporates a back portion and first and second abutment portions extending outwardly from the body portion. Free ends of the abutment portions are formed at opposing ends of the body and are configured to engage each other. A pair of fingergrips also are provided that are configured with two legs that are spaced from each other. Each of the fingergrips include a gripping end and a pair free ends, with the free ends being retained at respective free ends of the abutment portions. Additionally, a corner-receiving opening is formed through the back portion, with the corner-receiving opening being characterized by a width greater than the spacing of the legs of the fingergrips. So configured, the corner-receiving opening may receive therethrough a corner portion of a stack of sheets of material.

14 Claims, 4 Drawing Sheets

CORNER CLIP

CROSS REFERENCE TO RELATED APPLICATIONS

This application is a utility application based on and claiming priority to U.S. provisional Application Ser. No. 60/237,877, filed on Oct. 4, 2000, which is incorporated by reference herein.

BACKGROUND OF THE INVENTION

1. Field of the Invention

The present invention generally relates to clips for securing sheets of paper and, in particular, to clips that are adapted to grip sheets of paper while, preferably, being positioned about the corners of the sheets.

2. Description of the Related Art

Generally, it is known to secure loose sheets of paper by utilizing various fasteners, such as staples and paperclips, among others. In this regard, double clips have been utilized that incorporate a body, typically made from a band-like plate, and a pair of fingergrips attached to the body. The body of such a double clip includes a back portion configured to have a length substantially corresponding to a maximum clipping thickness of the clip, and abutment portions extending outwardly from the back portion. Respective free ends of the abutment portions extend inwardly toward each other and abut against each other elastically. The pair of fingergrips, which typically are formed from hard metal wire, are rotatably engaged by the free ends of the abutment portions. So configured, a stack of sheets of paper may be engaged and securely retained by the clip by rotating the free ends of the two fingergrips toward the back portion of the body, and then, once engaging the back portion, towards each other, thereby spreading the free ends of the abutment portions to form an opening for placing the papers therein. Once the papers are suitably positioned, the fingergrips may be released, thus allowing the free ends of the abutment portions to be elastically urged toward each other so that the papers are secured therebetween.

As is known, the aforementioned double clip is particularly well suited for gripping a stack of sheets of paper; however, the band-like plate of the abutment portions oftentimes tends to obstruct an appreciable portion of the uppermost and lowermost sheets of such a stack from view. Therefore, there is a need for improved clips which address these and other shortcomings of the prior art.

SUMMARY OF THE INVENTION

Briefly described, the present invention relates to a clip that is adapted to grip sheets of material, such as paper, while the clip is positioned about the corners of the sheets. In this regard, a preferred embodiment of such a clip includes a body formed from a length of band-like material. The body incorporates a back portion and first and second abutment portions extending outwardly from the body portion. Free ends of the abutment portions are formed at opposing ends of the body and are configured to engage each other. A pair of fingergrips also are provided that are configured with two legs that are spaced from each other. Each of the fingergrips include a gripping end and a pair free ends, with the free ends being retained at respective free ends of the abutment portions. Additionally, a corner-receiving opening is formed through the back portion, with the corner-receiving opening being characterized by a width greater than the spacing of the legs of the fingergrips. So configured, the corner-receiving opening may receive therethrough a corner portion of a stack of sheets of material.

An alternative embodiment of the clip includes a body, a pair of fingergrips, and means for receiving therethrough a corner portion of a stack of sheets of material.

Other features and advantages of the present invention will become apparent to one with skill in the art upon examination of the following drawings and detailed description. It is intended that all such features and advantages be included herein within the scope of the present invention, as defined in the appended claims.

BRIEF DESCRIPTION OF THE SEVERAL VIEWS OF THE DRAWINGS

The present invention, as defined in the claims, can be better understood with reference to the following drawings. The drawings are not necessarily to scale, emphasis instead being placed on clearly illustrating the principles of the present invention.

DETAILED DESCRIPTION OF A PREFERRED EMBODIMENT

Figure 1:
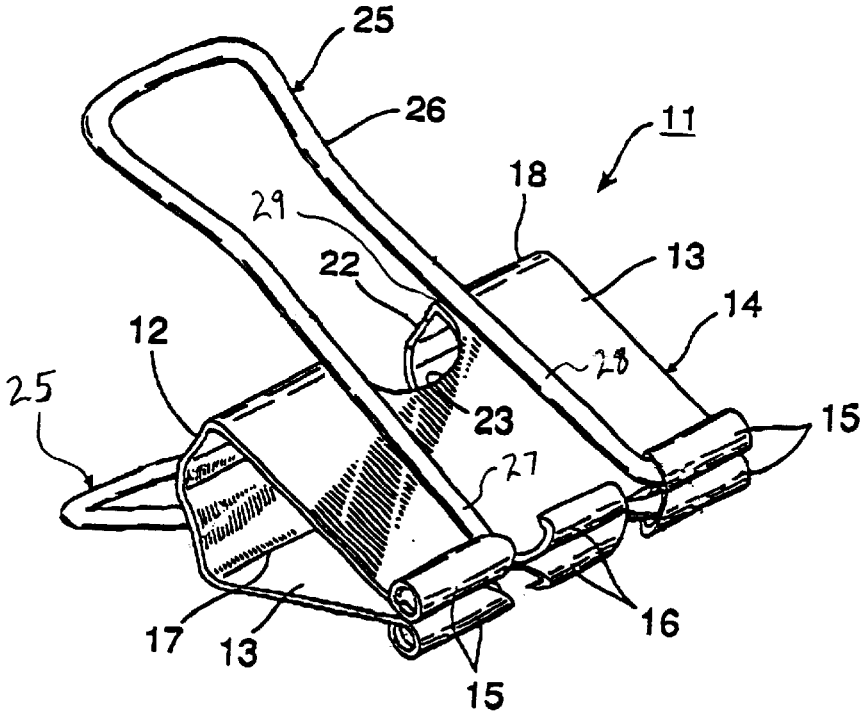
FIG. 1 (PRIOR ART)
FIG. 1 is a perspective view of a prior art clip.
Figure 2:
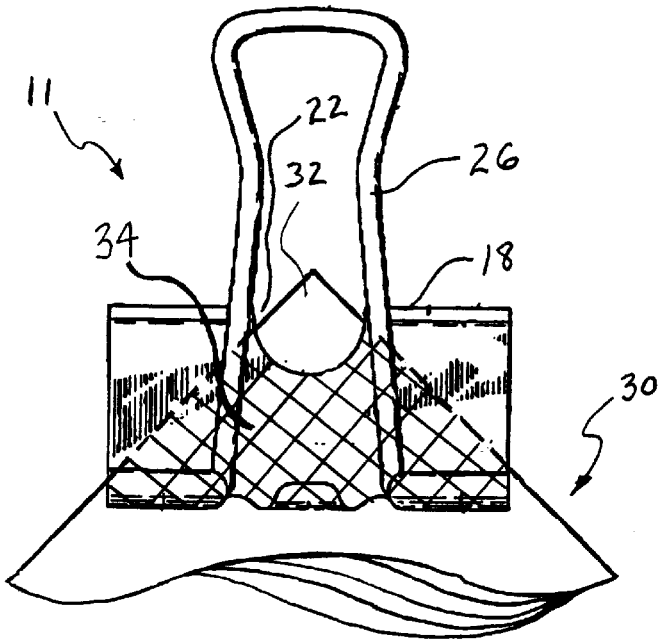
FIG. 2 (PRIOR ART)
FIG. 2 is a plan view of the prior art clip depicted in FIG. 1.

Referring now to FIGS. 1 and 2, a representative prior art clip 11 will be described in greater detail. As depicted in FIG. 1, clip 11 incorporates a body 14 which is formed by bending a band-like metal plate, i.e., a plate formed of steel, stainless steel, or the like, and fingergrips 25 made from hard metal wires. Body 14 includes a back portion 12 and a pair of abutment portions 13 that are formed by bending the plate. The back portion 12 has a length substantially corresponding to the maximum clipping thickness of the clip 11. The back portion 12 and the abutment portions elastically engage each other so that free ends of the abutment portions may abut against each other. At the free ends of each of the abutment portions 13, a pair of lock portions 15 is formed, such as by bending the edges of the free ends into rings. Additionally, an edge portion 16 of the abutting edge between the locking portions 15 may be bent in a manner similar to the locking portions.

As shown in FIGS. 1 and 2, an opening 22 preferably is provided substantially in a widthwise center portion of back portion 12. Notches 23 are formed in the respective abutment portions 13 substantially in their widthwise center portions so that the notches 23 engage the opening 22. Fingergrips 25 are rotatably inserted into the locked portions 15 with each fingergrip including a fingergrip body 26. A distance between leg portions 27 and 28 of each of the fingergrip bodies 26 is made larger than the width of the opening 22 formed in the back portion so that when the fingergrip bodies 26 are gripped by fingers and rotated toward the back portion 12, the fingergrip bodies 26 abut against shoulder portions 29 of the clip body 14. So configured, the bent portions 17 and 18 which, generally, are caused to engage the respective fingergrips, are made to be fulcrums of rotation of the fingergrips 25. Thus, when the fingergrip bodies 26 are gripped by fingers and caused to rotate about the respective fulcrums 17 and 18, the free ends of the abutment portions disengage from each other so that a stack of sheets of paper 30 may be placed therebetween. For instance, when the stack of sheets of paper are to be clipped at the corner thereof (as depicted in FIG. 2), the corner 32 of the stack may be inserted into the clip 11 so that the corner projects out through the opening 22. However, due to the limited size of the opening 22, i.e., the size of the opening being limited by the spacing of the legs of the fingergrips, a substantial portion 34 (depicted in cross-hatching) of the uppermost, as well as the lowermost, sheets of the stack may be obstructed from view.

Figure 3:
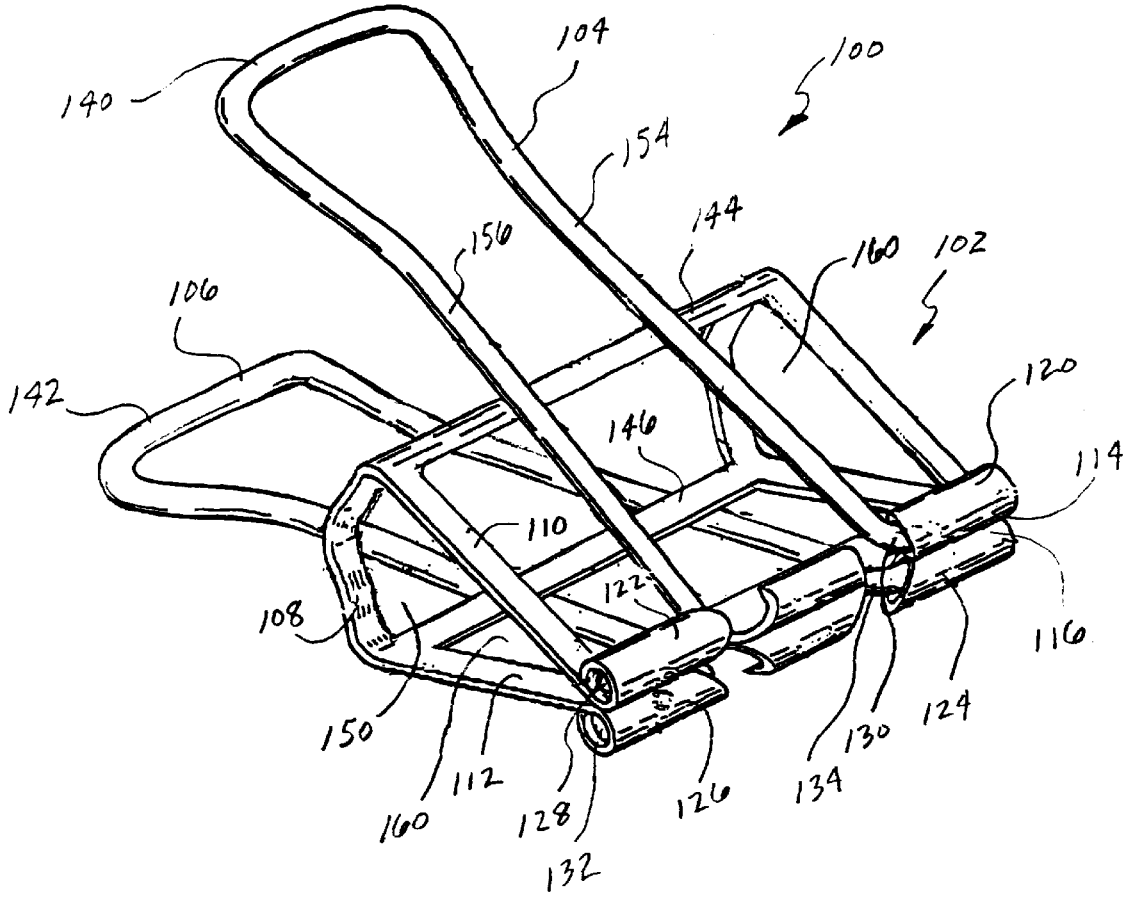
FIG. 3 is a perspective view of a preferred embodiment of the present invention.
Figure 4:
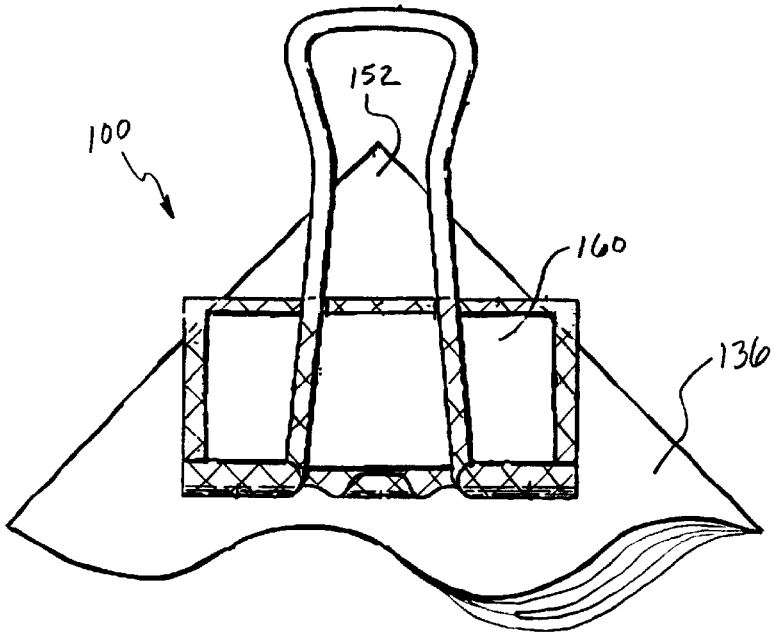
FIG. 4 is a plan view of the embodiment depicted in FIG. 3.

Reference will now be made to FIGS. 3 and 4, which depict a preferred embodiment of the invention. As shown in FIG. 3, a preferred embodiment of the clip 100 includes a body 102, and first and second fingergrips 104 and 106, respectively. Body 102 incorporates a back portion 108 and a pair of abutment portions, 110 and 112, which extend outwardly from the back portion and toward each other and, so that the distal or free ends 114 and 116 of the abutment portions engage each other preferably, the body is formed from a sheet of band-like material that is bent to form the various portions so that elastic forces of the material tend to urge the free ends of the abutment portions toward engagement.

The free ends of the abutment portions preferably include retainer portions, e.g., 120, 122, 124 and 126, which are adapted to receive free ends, e.g., ends 128 and 130, and 132 and 134 of the fingergrips. So provided, the free ends of the fingergrips may be received and rotatably retained by the retainer portions.

In operation, e.g., when a stack of sheets of paper 136 are to be gripped by the clip 100, the fingergrips may be rotated toward the back portion until the fingergrips engage the body. Thereafter, the gripping ends 140 and 142 of the fingergrips may be urged toward each other, thereby causing the fingergrips to pivot about respective fulcrums 144 and 146 of the body so that further urging of the gripping ends toward each other causes the free ends of the abutment portions to be drawn away from each other. Once the free ends of the abutment portions have been withdrawn a suitable distance from each other, e.g., a distance which is suitable to accommodate a thickness of a stack of sheets of paper to be gripped by the clip, the stack may be inserted between the abutment portions. The gripping ends of the fingergrips may then be released, thereby allowing the free ends of the abutment portions to securely engage the stack.

Referring more closely to the embodiment depicted in FIGS. 3 and 4, it should be noted that such an embodiment includes one or more enhancements, as compared to the prior art, which may intend to improve the functionality of the clip. In particular, preferred embodiments of the clip 100 include a corner-receiving opening 150 formed through the back portion that is adapted for receiving the corner portion 152 of a stack of sheets of paper therethrough, such as depicted in FIG. 4. Preferably, the corner-receiving opening is characterized by a width that is greater than the spacing of leg portions, e.g., leg portions 154 and 156, of the fingergrips of the clip. It is to be appreciated that such a large opening, as compared to the size of the body of the clip, may allow for a more secure engagement of the abutment portions about a stack of sheets of paper and may enhance the ability of the clip to secure the sheets of such a stack.

Additionally, one or more of the abutment portions may include an opening 160 which may have a width that is greater than the spacing of the legs of the fingergrips. So provided, the opening(s) 160 may provide for an increased unobstructed viewing area of the uppermost and/or lowermost sheets of a gripped stack, thereby allowing a viewer to view a greater portion of the uppermost and/or lowermost sheets of the stack without having to reposition the clip during viewing. For those embodiments incorporating one or more openings 160, as well as a corner-receiving opening, it is envisioned that an enlarged opening 160 tends to compensate for the potential of the clip to obstruct the view of a greater portion of the uppermost and/or lowermost sheets of the stack, as compared to the prior art, as the corner-receiving opening allows the clip to be positioned closer to the center of the sheet. The reduced obstructed area of view 164 is depicted in crosshatching.

Figure 5:
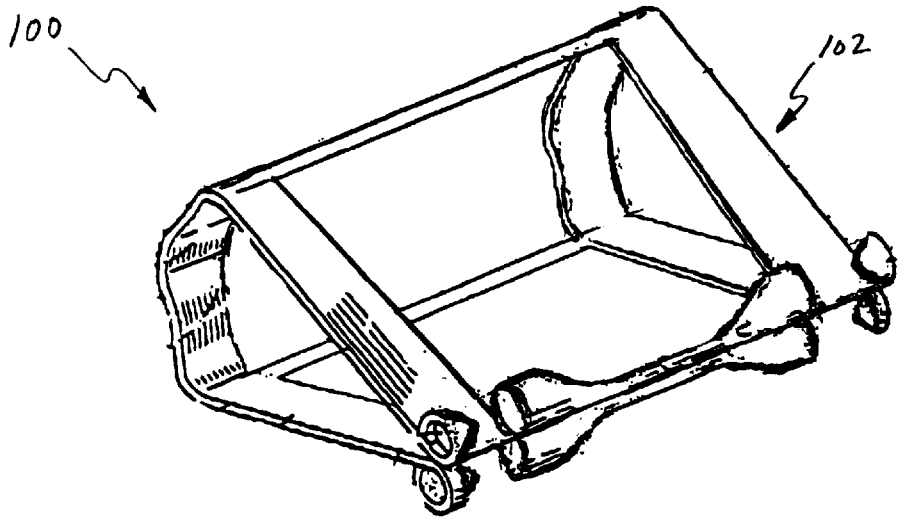
FIG. 5 is a perspective view of the embodiment depicted in FIGS. 3 and 4 shown without fingergrips.

Although depicted as forming a portion of the respective abutment portions, (not shown) the fulcrums or beams may be formed as portions of the back portion and/or the abutment portions, (as depicted in FIGS. 3 and 5, for example) as desired.

Figure 6:
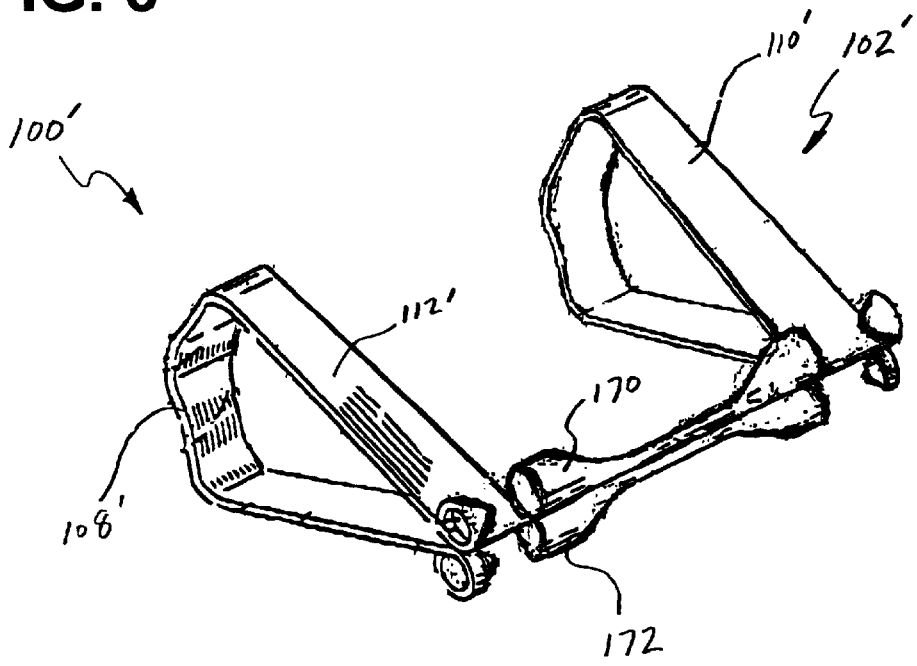
FIG. 6 is an alternative embodiment of the present invention shown without fingergrips.

Referring now to FIG. 6, an alternative embodiment 100' will be described in greater detail. As shown in FIG. 6 (which is depicted absent fingergrips), body 102' includes a back portion and respective abutment portions 110' and 112' that do not incorporate beams. In contrast to the beamed-configuration of the embodiment depicted in FIGS. 3–5, the embodiment 100' incorporates a beamless structure of the abutment portions is sufficiently robust to maintain structural integrity of the body. In particular, the free ends incorporate retainer portions 170 and 172, respectively. The retainer portions preferably are adapted to receive free ends of a fingergrip in an inwardly disposed direction, in contrast to the outwardly disposed direction of the retainer configuration in the embodiment depicted in FIGS. 3 and 4 (such a retainer configuration also is depicted in FIG. 5). It should be noted that the lack of a beam increases the unobstructed viewing area.

Figure 7:
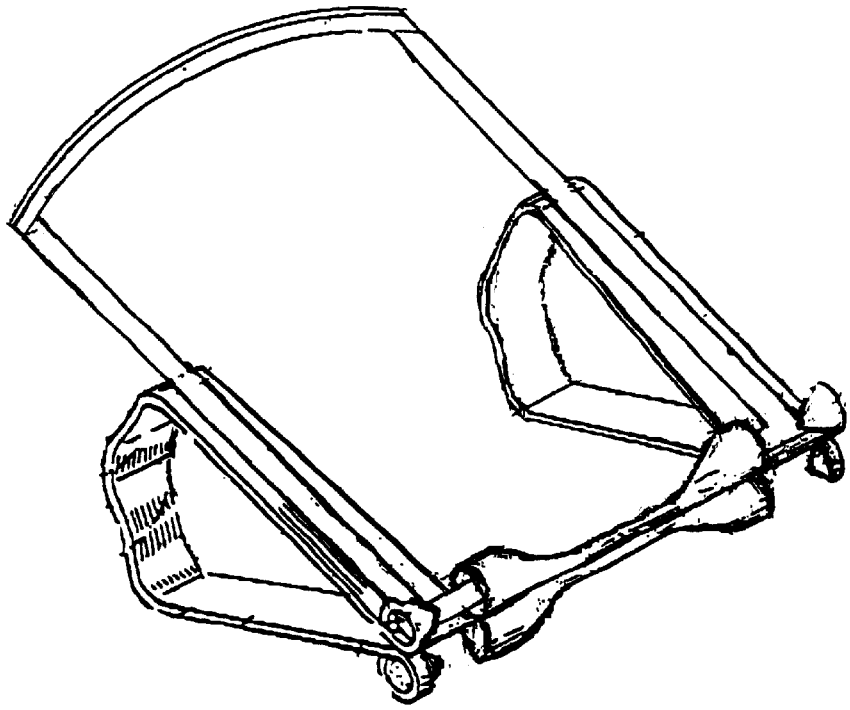
FIG. 7 is a perspective view of the embodiment depicted in FIG. 6 shown with a representative fingergrip.
Figure 8:
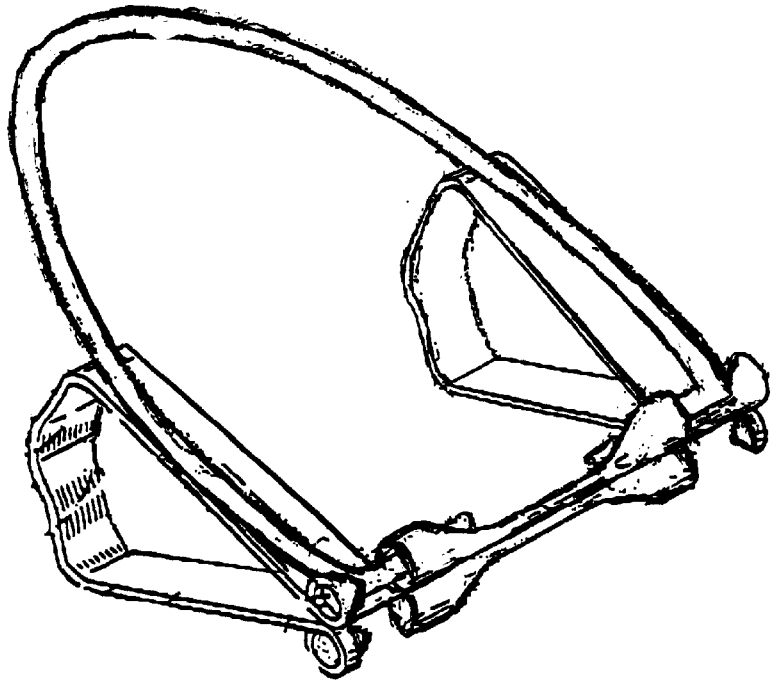
FIG. 8 is a perspective view depicted in FIGS. 6 and 7 shown with an alternative fingergrip.

As shown in greater detail in FIGS. 7 and 8, the embodiment 100' utilizes the substantially outermost opposing portions of the abutment portions as fulcrums for engaging the fingergrips, e.g., fingertip 104', (only one fingertip is shown for clarity and ease of description). So configured, the segregated corner-receiving opening 150 and opening(s) 160 of the embodiment 100 preferably are replaced by a contiguous opening 180 which functions both as a corner-receiving opening and an opening for providing an improved unobstructed view of the uppermost and lowermost sheets of a stack of paper to be received by the clip.

The foregoing description has been presented for purposes of illustration and description. It is not intended to be exhaustive or to limit the invention to the precise forms disclosed. Modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

What is claimed is:

1. A clip for gripping a stack of sheets of material, said clip comprising:

a body formed from a length of band-like material, said body having a back portion and first and second abutment portions extending outwardly from said back portion, said first and second abutment portions each having a free end formed at opposing ends of said body, said body being formed such that said free ends of said abutment portions are urged toward engagement with each other;

a pair of fingergrips each having two legs spaced from each other, each of said fingergrips having a gripping end and a pair free ends, said free ends of each of said legs being retained at respective free ends of the abutment portions;

a corner-receiving opening formed through a center portion of said back portion, said corner-receiving opening having a width greater than the spacing of said legs of said fingergrips, said corner-receiving opening being configured to receive therethrough a corner portion of a stack of sheets of material; and wherein said first abutment portion has a first abutment portion opening formed therethrough.

2. The clip of claim 1, wherein said fingergrips rotatably engage said body.

3. The clip of claim 1, wherein said corner-receiving opening and said first abutment portion opening are separated by a first beam.

4. The clip of claim 1, wherein said first abutment portion opening has a width greater than the spacing of said legs of said fingergrips.

5. A clip for gripping a stack of sheets of material, said clip comprising:

a body formed from a length of band-like material, said body having a back portion and first and second abutment portion extending outwardly from said back portion, said first and second abutment portions each having a free end formed at opposing ends of said body, said body being formed such that said free ends of said abutment portions are urged toward engagement with each other;

a pair of fingergrips each having two legs spaced from each other, each of said fingergrips having a gripping end and a pair free ends, said free ends of each of said legs being retained at respective free ends of the abutment portions;

a corner-receiving opening formed through a center portion of said back portion, said corner-receiving opening having a width greater than the spacing of said legs of said fingergrips, said corner-receiving opening being configured to receive therethrough a corner portion of a stack of sheets of material; and wherein said second abutment portion has a second abutment portion opening formed therethrough.

6. The clip of claim 5 wherein said corner-receiving opening and said second abutment portion opening are separated by a second beam.

7. The clip of claim 5, wherein said second abutment portion opening has a width greater than the spacing of said legs of said fingergrips.

8. The clip of claim 5, wherein said fingergrips rotatably engage said body.

9. The clip of claim 3, wherein said first beam is formed along at least a portion of said back portion.

10. The clip of claim 3, wherein said first beam is formed along at least a portion of said first abutment portion.

11. The clip of claim 6 wherein said second beam is formed along at least a portion of said back portion.

12. The clip of claim 6, wherein said second beam is formed along at least a portion of said second abutment portion.

13. A clip for gripping a stack of sheets of material, said clip comprising:

a body formed from a length of band-like material, said body having a back portion and first and second abutment portions extending outwardly from said body portion, said first and second abutment portions each having a free end formed at opposing ends of said body, said body being formed such that said free ends of said abutment portions are urged toward engagement with each other;

a pair of fingergrips each having two legs spaced from each other, each of said fingergrips having a gripping end and a pair free ends, said free ends of each of said legs being retained at respective free ends of the abutment portions;

means for receiving therethrough a corner portion of a stack of sheets of material;

means for viewing a sheet of material engaged between said first abutment portion and said second abutment portion; and wherein said means for viewing comprises a first abutment portion opening formed through said first abutment portion.

14. A clip for gripping a stack of sheets of material, said clip comprising:

a body formed from a length of band-like material, said body having a back portion and first and second abutment portions extending outwardly from said body portion, said first and second abutment portions each having a free end formed at opposing ends of said body, said body being formed such that said free ends of said abutment portions are urged toward engagement with each other;

a pair of fingergrips each having two legs spaced from each other, each of said fingergrips having a gripping end and a pair free ends, said free ends of each of said legs being retained at respective free ends of the abutment portions;

means for receiving therethrough a corner portion of a stack of sheets of material;

means for viewing a sheet of material engaged between said first abutment portion and said second abutment portion; and wherein said means for viewing comprises a second abutment portion opening formed through said second abutment portion.

* * * * *